US011109682B2

(12) United States Patent
Yang

(10) Patent No.: US 11,109,682 B2
(45) Date of Patent: Sep. 7, 2021

(54) FOLDING CHAIR, FOLDING RECLINER AND FOLDING CHAIR FRAME THEREOF

(71) Applicant: Zhejiang Topsun Creative Design Co., Ltd., Hangzhou (CN)

(72) Inventor: Baoqing Yang, HangZhou (CN)

(73) Assignee: Zhejiang Topsun Creative Design Co., Ltd., Zhejiang (CN)

( * ) Notice: Subject to any disclaimer, the term of this patent is extended or adjusted under 35 U.S.C. 154(b) by 0 days.

(21) Appl. No.: 16/526,039

(22) Filed: Jul. 30, 2019

(65) Prior Publication Data

US 2019/0350364 A1 Nov. 21, 2019

(30) Foreign Application Priority Data

Mar. 7, 2019 (CN) ..... PCT/CN2019/077308

(51) Int. Cl.
*A47C 4/28* (2006.01)
*A47C 5/10* (2006.01)
(Continued)

(52) U.S. Cl.
CPC ..... *A47C 4/286* (2013.01); *A47C 1/0342* (2013.01); *A47C 5/10* (2013.01); *A47C 4/30* (2013.01)

(58) Field of Classification Search
CPC ..... A47C 4/286; A47C 4/30; A47C 4/045; A47C 4/22; A47C 5/10; A47C 1/0342; A47C 4/283; A47C 4/28; A47C 1/035
(Continued)

(56) References Cited

U.S. PATENT DOCUMENTS 4,072,341 A * 2/1978 Kurz ..... A47C 1/035 267/179
6,692,068 B1 * 2/2004 Tang ..... A47C 1/035 297/16.2
(Continued)

FOREIGN PATENT DOCUMENTS

CN 2897032 Y 5/2007
CN 201533682 U 7/2010
(Continued)

*Primary Examiner* — Milton Nelson, Jr.
(74) *Attorney, Agent, or Firm* — Matthew J. Himich

(57) ABSTRACT

A folding chair frame, a folding recliner and a folding chair frame are provided. A foot tube assembly includes a front foot tube and a rear foot tube hingedly connected at a top, the rear foot tube is provided with a first connector, the front foot tube is provided with a seat tube, which has one end hinged to the front foot tube and another end hinged to the first slider, and the first slider is hinged to a backrest tube; two sets of the foot tube assemblies are oppositely provided, each rear foot tube is respectively provided with a second connector connected to a connecting tube having one end hinged thereto and another end hinged to one front foot tube, the front end of each seat tube is respectively provided with a front cross tube having one end hinged thereto and another end hinged to a bottom end of the foot tube of the other set of the foot tube assembly opposite to the foot tube assembly in which the seat tube is located. In this assembly, the front foot tubes and the rear foot tubes are unfolded by gravity and secured by the first sliders and the second sliders on the rear foot tubes, to solve the more complicated problem of manual operation on the supporting structure to achieve the folding in the conventional technology.

20 Claims, 17 Drawing Sheets

(51) Int. Cl.
*A47C 1/034* (2006.01)
*A47C 4/30* (2006.01)

(58) Field of Classification Search
USPC ..... 297/45, 30
See application file for complete search history.

(56) References Cited

U.S. PATENT DOCUMENTS

| | | | | |
|---|---|---|---|---|
| 2003/0006632 | A1* | 1/2003 | Ku ..... | A47C 4/286<br>297/45 |
| 2010/0237665 | A1* | 9/2010 | Grace ..... | A47C 4/46<br>297/16.2 |

FOREIGN PATENT DOCUMENTS

| | | | | |
|---|---|---|---|---|
| CN | 202820372 | U | 3/2013 | |
| CN | 208318773 | U | 1/2019 | |
| WO | WO-9009749 | A1 * | 9/1990 | ..... A47C 4/286 |

* cited by examiner

FOLDING CHAIR, FOLDING RECLINER AND FOLDING CHAIR FRAME THEREOF

RELATED APPLICATION DATA

The application claims the benefit of PCT Application Ser. No. PCT/CN2019/077308, filed Mar. 7, 2019, which claims priority to Chinese patent application No. 201820328362.7 titled "FOLDING CHAIR, FOLDING RECLINER AND FOLDING CHAIR FRAME THEREOF", filed with the China National Intellectual Property Administration on Mar. 9, 2018, the disclosures of which are incorporated herein by reference in its entirety.

FIELD

The present application relates to the technical field of folding chairs, and in particular to a folding chair frame, to a folding chair having the folding chair frame, and to a folding recliner having the folding chair frame.

BACKGROUND

Conventional folding chair designs have a complicated support structure that must be expanded and collapsed. The support structure is oftentimes difficult to fold and unfold, and may be unstable. Also, the support structure contributes to the chair not having a very high level of comfort for the user. Accordingly, complicated folding and unfolding, and low comfort are problems to be solved.

SUMMARY

In view of this, an object of the present application is to provide a folding chair frame to solve problems, such as complicated folding and unfolding, and low comfort.

To achieve the above object, the following technical solutions are provided according to the present application.

A folding chair frame is provided, which includes left and right foot tube assemblies. The right foot tube assembly is provided opposite of the left tube assembly and has a similar structure. The left foot tube assembly includes a front foot tube and a rear foot tube hingedly connected together at their respective tops. The rear foot tube is provided with a first connector. The front foot tube is provided with a seat tube. The seat tube is hingedly connected to the front foot tube. An end of the seat tube is hingedly connected to the first connector. The first connector is also hingedly connected to a backrest tube. The rear foot tube is also provided with a second connector. A connecting tube has one end hingedly connected to the second connector. A second end of the connecting tube is hingedly connected to the front foot tube. The front end of each seat tube is respectively provided with a front cross tube, which has one end hingedly connected thereto and another end hingedly connected to a bottom end of the foot tube of the opposite foot tube assembly (that is, the foot tube assembly opposite to the foot tube assembly in which the seat tube is located).

Preferably, the first connector is embodied as a first slider which is slidable along the respective rear foot tube, and preferably, the second connector is embodied as a second slider which is slidable along the respective rear foot tube.

Preferably, the top of each backrest tube of the left and right foot tube assemblies are respectively provided with a rear cross tube, which has one end hingedly connected thereto and another end operatively hingedly connected to an opposite foot tube assembly connecting tube.

Preferably, the front foot tube and the front cross tube are hingedly connected by a foot connector at a bottom of the front foot tube. The foot connector has one end fixedly connected to the respective front foot tube and another end pivotally connected to the respective front cross tube.

Preferably, a bottom end of the rear foot tube is sleeved with an anti-slip foot cover for preventing slipping.

Preferably, the top of the front foot tube and the top of the rear foot tube are hingedly connected to an armrest. The arm rest has one end hingedly connected to one backrest tube to achieve pitch adjustment of the respective backrest tube.

Preferably, the first slider along the respective rear foot tube is located above the respective second slider. When the folding chair frame is fully unfolded, the first slider may be in contact with the second slider and the hinged connection point of the backrest tube with the first slider may be in contact with the hinged connection point of the rear cross tube with the second slider.

Preferably, the front cross tube and the rear cross tube are cross-hinged and crosswise arranged, and a center of each of the cross tubes is provided with the fixed axle for providing a pivot.

Preferably, the first connector and the second connector are respectively embodied as a flip connector set.

Preferably, a set of rear cross tubes that are crosswise to each other. The rear cross tubes may be hingedly connected to and extend between the two sets of opposite backrest tubes. The first end of each of the rear cross tubes may be respectively hinged to a backrest tube, the second end of each of the rear cross tubes may be respectively hinged to a second connector.

Preferably, the rear foot tube is provided with a limiting member fixedly connected thereto. The limiting member limits a maximum sliding position of the first connector and the sliding position of the second connector on the rear foot tube when the folding chair frame is unfolded.

Preferably, the second connector is provided with a locking assembly that engages with the respective limiting member when the folding chair frame is unfolded and limits the sliding of the second connector along the rear foot tube.

Preferably, the locking assembly includes a hook provided on the second connector. A hook mounting hole is provided for mounting the hook on the second connector. A hook mounting shaft and a torsion spring sleeved on the hook mounting shaft are provided in the hook mounting hole. A limiting groove is provided on the limiting member for locking with the hook.

Preferably, the top hinged portion of the front foot tube and the rear foot tube are hinged to an armrest body, which has one end hinged to one backrest tube to adjust a pitch angle of the backrest tube in a case that the armrest body rotates.

Preferably, a sliding assembly is further provided between the armrest body and the top hinged portion to allow each armrest body to slide along its length to adjust the pitch angle of each backrest tube. The armrest body may be hinged to the top hinged portion through the sliding assembly. The sliding assembly includes a hinged seat that is hinged to the top hinged portion. The armrest body is slidable on the hinged seat. The hinged seat is provided with a sliding limit assembly for limiting the sliding of the respective armrest body.

Preferably, the front end of the seat tube is hingedly provided with a footrest tube. The footrest tube is hinged to a linkage tube. One end of the linkage tube is hinged to the footrest tube and another end of the linkage tube is hinged to a respective backrest tube. The footrest tube may be moved by the linkage tube to rotate about its hinged connection point with the front end of each seat tube to form a recliner as the backrest tube is pivoted back.

Preferably, a front cross-bracing connector is provided between the two footrest tubes for connecting the two footrest tubes together. The two opposite ends of the cross-bracing connector are respectively hinged to the two footrest tubes. The front cross-bracing connector may be folded up when the folding chair frame is folded. The front cross-bracing connector may be configured to support the footrest tube when the folding chair frame is unfolded.

Preferably, the cross-bracing connector includes a first connecting supporter and a second connecting supporter that are bisected along a center point of the cross-bracing connector and hinged. The first connecting supporter and the second connecting supporter are configured to horizontally support the footrest tube when the folding chair frame is unfolded.

Preferably, the cross-bracing connector includes the first connecting supporter and the second connecting supporter that are crosswise to each other and hingedly arranged, and one end of the first connecting supporter is hingedly arranged with one footrest tube and one end of the second connecting supporter is hingedly arranged with another footrest tube.

A folding chair is further provided according to the present application, which includes the above folding chair frame according to any one of the above embodiments.

The folding chair provided according to the present application includes left and right foot tube assemblies. Each of left and right foot tube assemblies includes a front foot tube and a rear foot tube hingedly connected at a top. The rear foot tube is provided with a first connector. The front foot tube is provided with a seat tube. The seat tube is hinged to the front foot tube and with an end hinged to the first connector. The first connector is hinged to a backrest tube. The rear foot tube is also provided with a second connector connected to a connecting tube. The connector tube has one end hinged to the second connector and another end hinged to the front foot tube. The front end of each seat tube is respectively provided with a front cross tube having one end hinged thereto and another end hinged to a bottom end of the foot tube of the opposite foot tube assembly (i.e., opposite to the foot tube assembly in which the seat tube is located).

According to the folding chair frame of the present application, the first connector is connected with the backrest tube and the respective seat tube, and the second connecting tube is connected with the rear cross tube and the connecting tube, so that the seat tubes and the backrest tubes are folded along the hinge of the rear foot tubes when the folding chair is folded, thereby reducing the package volume; when the folding chair is unfolded. The front foot tubes and the rear foot tubes are unfolded by gravity and secured by the first connectors and the second connectors on the rear foot tubes, so as to solve the more complicated problem of manual operation on the supporting structure to achieve the folding in the conventional technology.

BRIEF DESCRIPTION OF THE DRAWINGS

For clearer illustration of the technical solutions according to embodiments of the present disclosure or conventional techniques, hereinafter are briefly described the drawings to be applied in embodiments of the present disclosure or conventional techniques. The drawings in the following descriptions are illustrative and not limiting in any sense. While the drawings show some aspect of the present disclosure, other embodiments and variations may be obtained by those skilled in the art based on the provided drawings.

DETAILED DESCRIPTION

Figure 1:
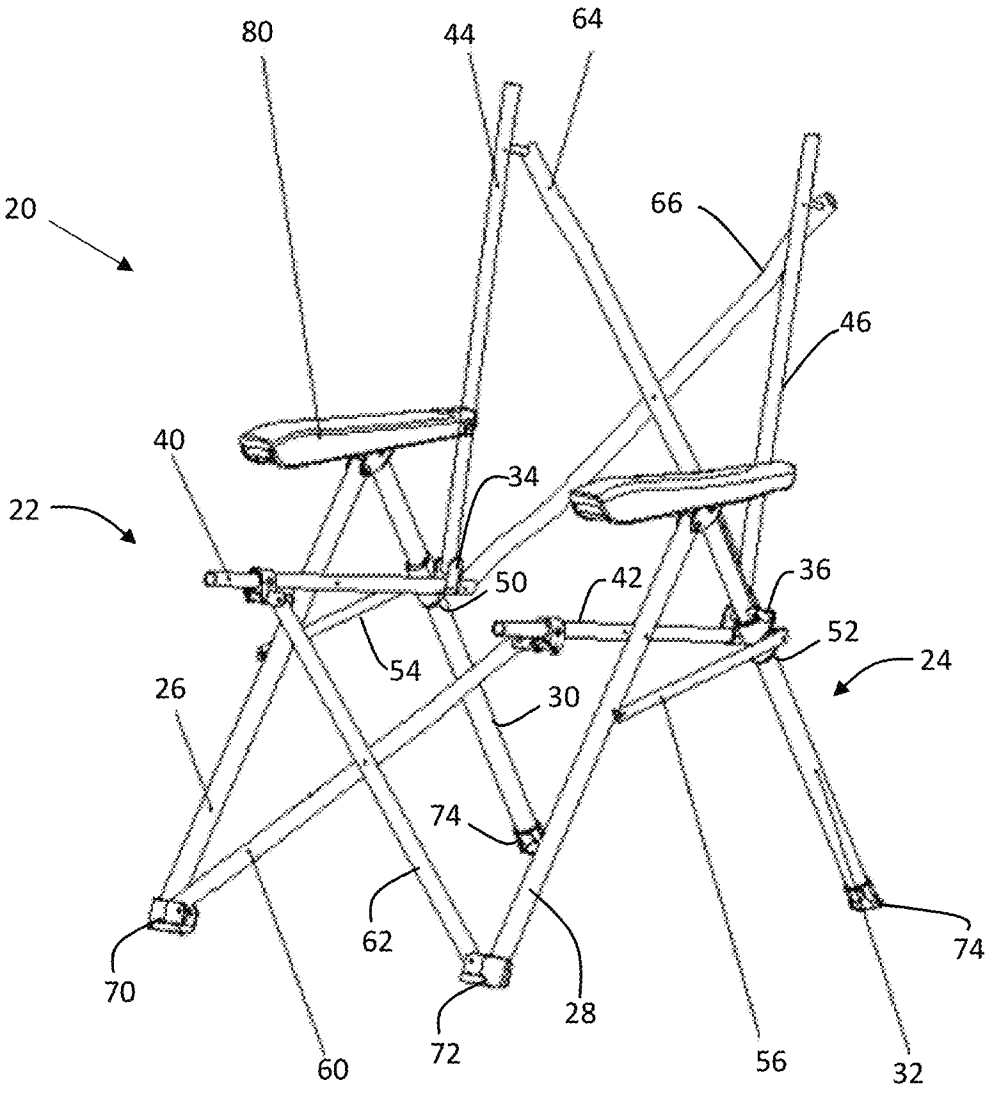
FIG. 1 is a front, right perspective view showing the overall structure of a folding chair frame according to an embodiment of the present application.
Figure 2:
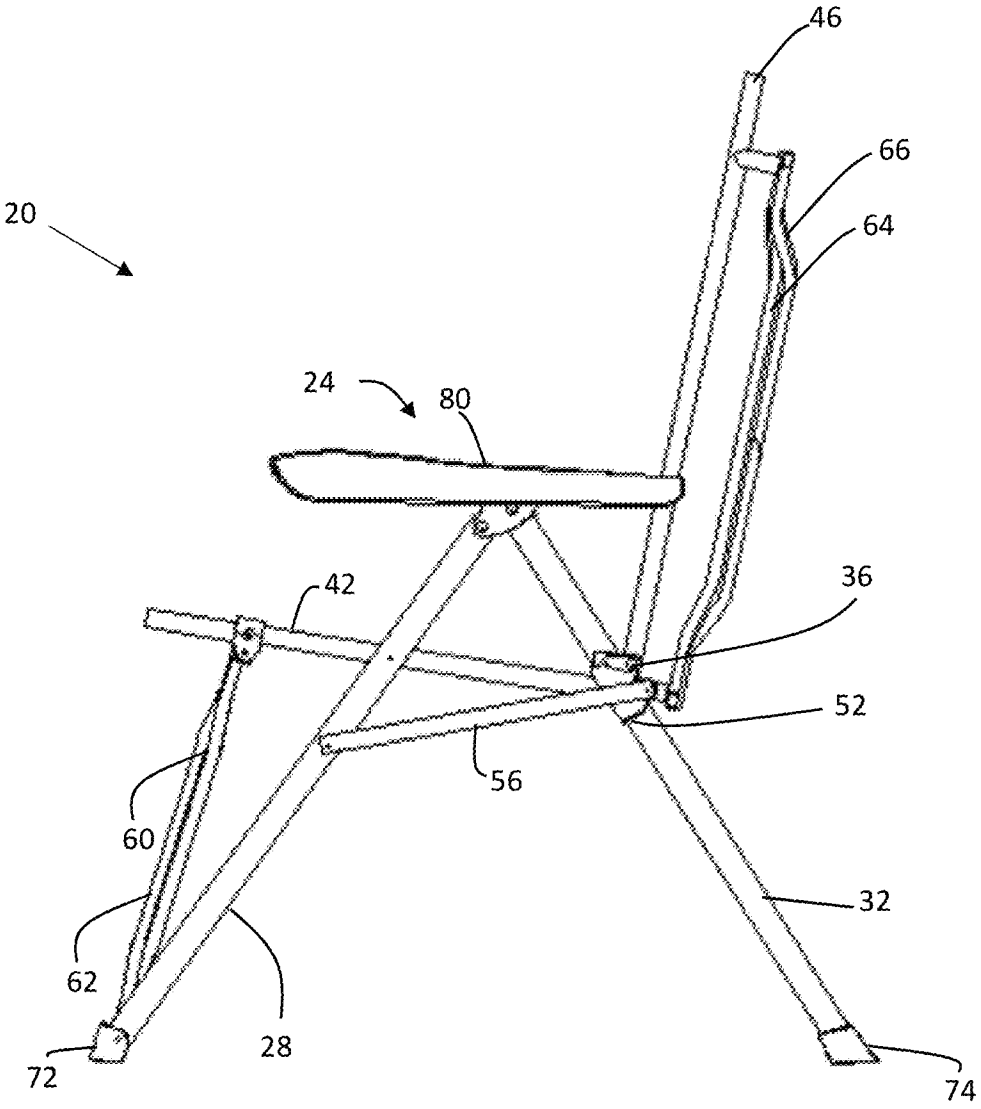
FIG. 2 is a right side elevation view showing the structure of the folding chair frame in FIG. 1.
Figure 3:
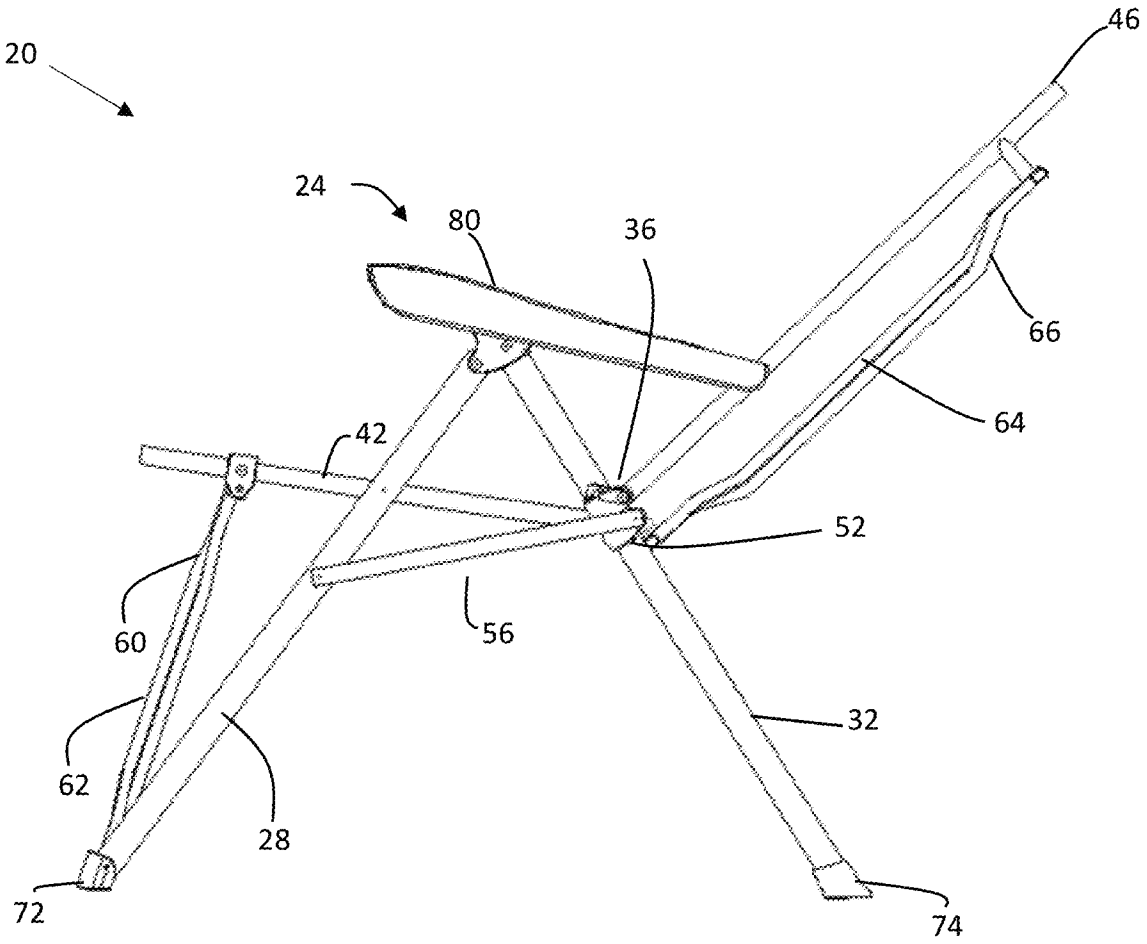
FIG. 3 is another right side elevation view showing an angle adjustment of a backrest tube of the folding chair frame according to the embodiment of the present application.
Figure 4:
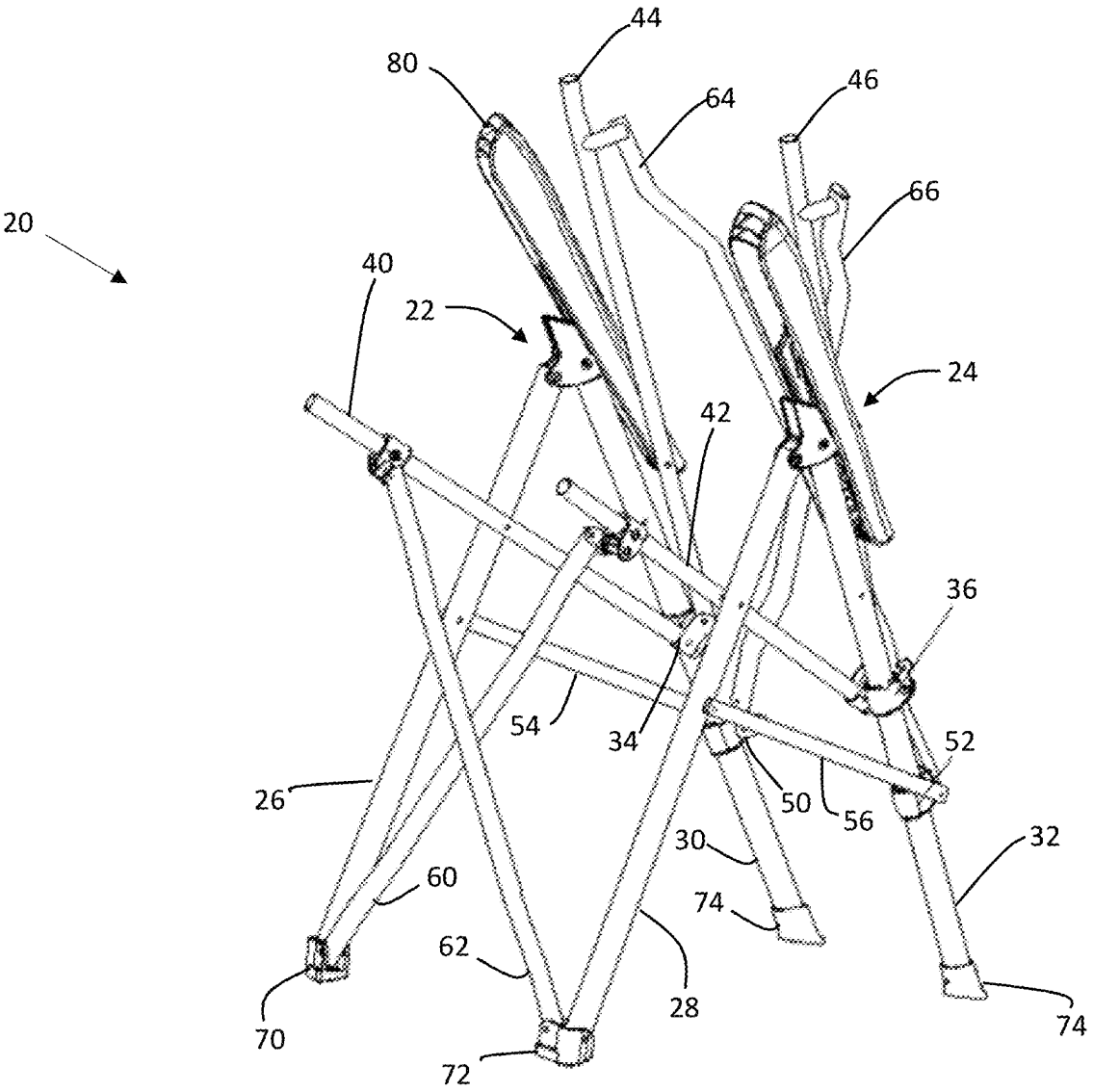
FIG. 4 is a front, right perspective view showing the structure of the folding chair frame in a partially folded state according to the embodiment of the present application.
Figure 6:
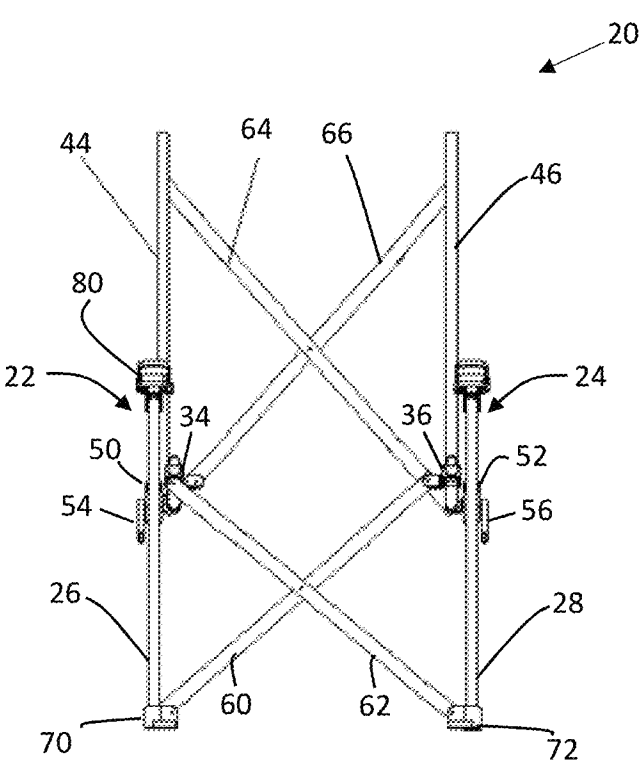
FIG. 6 is a front view of the folding chair frame in FIG. 1.
Figure 5:
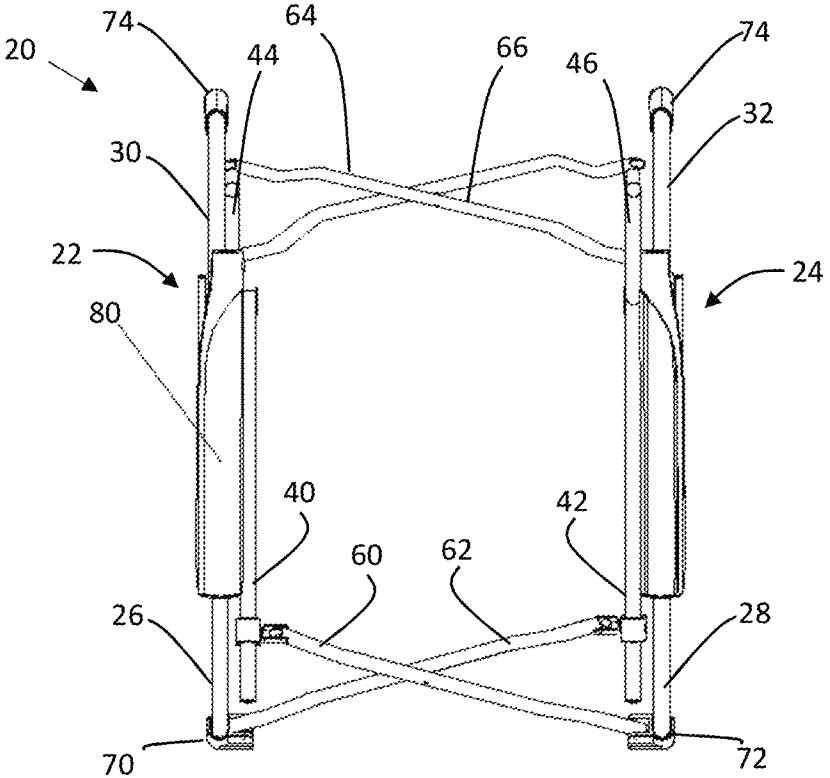
FIG. 5 is a top plan view of the folding chair frame in FIG. 1.
Figure 7:
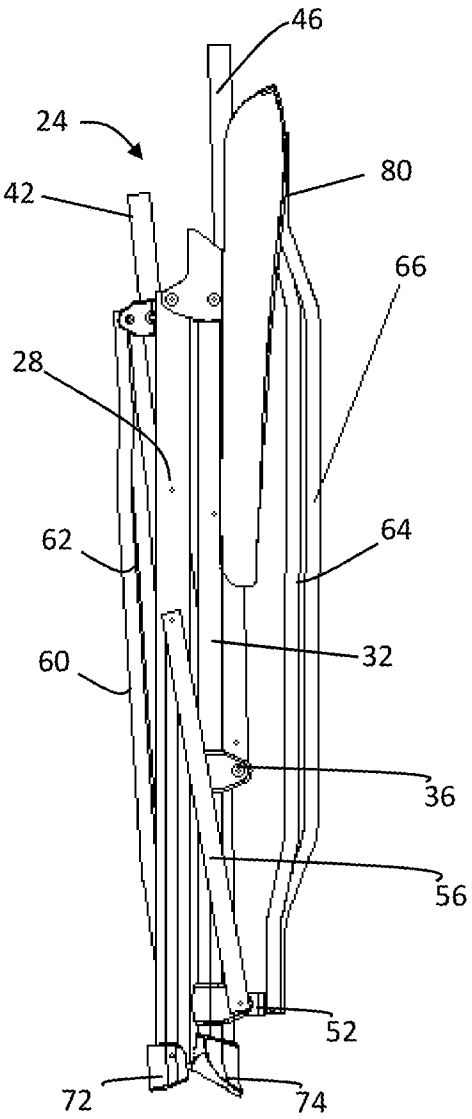
FIG. 7 is a side elevation view showing the structure of the folding chair frame in a fully folded state according to the embodiment of the present application.
Figure 8:
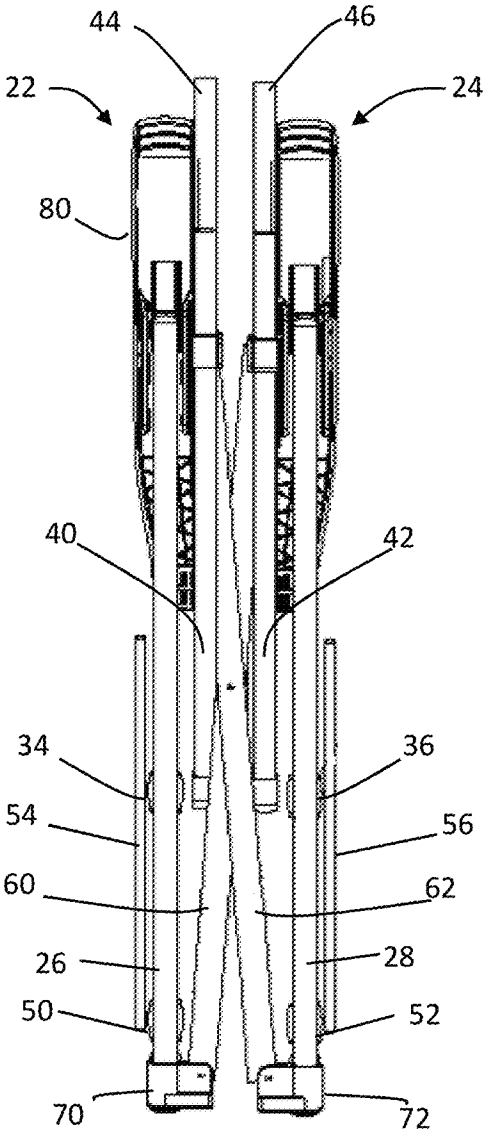
FIG. 8 is a front elevation view showing the structure of the folding chair frame in FIG. 7.

A folding chair frame is provided according to the present application, so as to solve the problems such as complicated folding when the folding chair is folded and low comfort.

FIGS. 1 to 8 show an overall structure of a folding chair frame 20 according to an embodiment of the present application. The folding chair frame may include left and right foot tube assemblies 22,24 each with a front foot tube 26,28 and a rear foot tube 30,32 hingedly connected at tops of the respective front and rear foot tubes. Each of the rear foot tubes 30,32 may be provided with a first connector 34,36. Each of the front foot tubes 26,28 may be provided with a seat tube 40,42, which may be hinged to the front foot tube 26,28 and hinged to the respective first connector 34,36. Each of the first connectors 34,36 may be hinged to a backrest tube 44,46. Each of the rear foot tubes 30,32 may be provided with a second connector 50,52. Each of the second connectors 50,52 may have a connecting tube 54,56. The connecting tube 54,56 may have one end hinged to the second connector 50,52 and another end hinged to a respective front foot tube 26,28. The front ends of the seat tubes 40,42 may be provided with front cross tubes 60,62. Each of the front cross tubes 60,62 may have one end hinged to the seat tube 40,42 and another end hinged to a bottom end of the opposite foot tube assembly 22,24 (that is, opposite to the foot tube assembly in which the seat tube is located). Each of the back rest tubes 44,46 may be connected with a rear cross tube 64,66. One end of the rear cross tube 64,66 may be hinged to a back rest tube 44,46, and the opposite of the rear cross tube may be hinged to the second connector 50,52.

In one embodiment, the first connector 34,36 is arranged as a first slider which is slidable along the respective rear foot tube 30,32, and the second connector 50,52 is arranged as a second slider which is slidable along the respective rear foot tube. The front foot tube 30,32 is provided with the seat tube 40,42, which has one end hinged the front foot tube and another end hinged to the first slider 34,36. The first slider 34,36 is hinged to the backrest tube 44,46.

The rear foot tube 30,32 is provided with the second slider 50,52 which is slidable on the rear foot tube. The second slider 50,52 is connected to the connecting tube 54,56, which has one end hinged to the second slider and another end hinged to the front foot tube 26,28. The front end of the seat tube 40,42 is provided with a front cross tubes 60,62, which have one end hinged to the seat tube 40,42 and another end hinged to a bottom end of the opposite foot tube assembly (that is, opposite to the foot tube in which the seat tube is located).

Top of the front foot tubes 26,28 and tops of the rear foot tubes 30,32 are hinged, and the maximum angle at which the front foot tube and the rear foot tube can be opened is related to the position of the connecting tube 54,56. Generally, the connecting tube 54,56 is provided in the middle portion so as to ensure that a height of the chair meets the comfort requirement of a human body, in which the arrangement position of the connecting tube can be set according to the actual requirement and the length of the foot tube assembly, which is not described herein. The first slider 34,36 provided on the rear foot tube 30,32 is slidable along the tube wall of the rear foot tube, in which a sliding groove can be provided on the tube wall of the rear foot tube, and a sliding protrusion can be provided on the inner wall of the first slider 34,36 to achieve the fitting. Of course, in other embodiments, the fitting can also be implemented by other means. The first slider 34,36 is hinged to the backrest tube 44,46 and the seat tube 40,42, in which the pitch angle of the backrest tube can be adjusted by the hinge of the backrest and the first slider, and the securing at a preset angle can be achieved by providing a groove on the first slider and providing a corresponding protrusion on backrest tube, so that it can be held at the preset angle and achieve the adjustment to the pitch angle of the backrest tube.

The rear foot tube 30,32 is provided with the second slider 50,52, which is slidable along the rear foot tube, and the second slider is hinged to the connecting tube 54,56, which has another end hinged to the front foot tube. When the second slider 50,52 slides down along the rear foot tube 30,32, the angle between the connecting tube 54,56 and the rear foot tube gradually becomes smaller, thereby allowing the hinged point of the rear foot tube with the front foot tube 26,28 to rotate, and allowing the angle between the front foot tube and the rear foot tube to change.

The bottom ends of the two front foot tubes 26,28 and the front ends of the two seat tubes 40,42 are connected to a front cross tube set 60,62. It should be understood that the front cross tube set 60,62 and rear cross tube set 64,66 both include a set of tubes which are cross-hinged and crosswise arranged. A pivot connection may be provided at the center of the tubes. The front cross tube set 60,62 includes two tubes arranged in a cross-hinged manner, and one end of each tube is connected to the front end of the seat tube 40,42 of one foot tube assembly and another end of the tube is connected to the bottom end of the front foot tube 26,28 of the other foot tube assembly to achieve crosswise arrangement, which can achieve rapid folding when the chair is folded. It can be understood that, in one embodiment, the rear cross tube sets 64,66 can also be correspondingly arranged on the backrest tube 44,46 to achieve the reclining and supporting function. Of course, in other embodiments, the above arrangement may be omitted, and the supporting or the reclining function may be implemented by providing a belt or other assembly, which may be provided according to actual requirements, all of which are within the protection scope of the present application.

The above hinged manner can be achieved by providing a screw or a rotating shaft as a center of the rotation. Of course, in other embodiments, other forms of the hinge can be selected as long as the same technical effect can be achieved.

Preferably, the tops of the backrest tubes 44,46 of the two sets of the foot tube assemblies 22,24 that are oppositely provided are respectively provided with the rear cross tube set 64,66 having one end hinged to the backrest tube and another end hinged to the connecting tube 54,56 and the second connector 50,52. When the connecting tube 54,56 slides down the rear foot tube 30,32, it allows the rear cross tube set 64,66 and the connecting tube to rotate, and then the angle between the rear cross tube and the connecting tube becomes smaller, thereby folding is achieved.

In one embodiment, the front foot tube 26,28 and the front cross tube 60,62 are hinged through a foot connector 70,72. The foot connector 70,72 may have one end fixedly connected to the front foot tube 26,28 and another end provided with a mounting hole. The front cross tube 60,62 is hinged to the front foot tube 26,28 and the foot connector 70,72 through the fixing rod and the mounting hole. Such arrangement can achieve the angle change between the front cross tube and the front foot tube to allow folding of the chair frame. Of course, in other embodiments, the above arrangement may be omitted. It is also possible to directly provide the mounting hole and a rotating shaft on the front foot tube in order to hinge the front foot tube with the front cross tube without use of the foot connector. All of which are within the protection scope of the present application.

In one embodiment, the rear foot tube 30,32 is mounted with an anti-slip foot cover 74 for preventing slipping. Preferably, the front foot tube foot connector 70,72 can also be correspondingly arranged to increase the friction with the ground, to prevent the device from damage and to prolong the service life. The anti-slip foot cover 70,72,74 can preferably be made of rubber.

Preferably, the top of the front foot tube 26,28 and the top of the rear foot tube 30,32 are hinged with an armrest 80. The armrest 80 may have one end hinged and secured to the backrest tube 44,46 to achieve the adjustment of the pitch of the backrest tube. The folding of the chair frame 20 and the adjustment of the pitch of the backrest tube 44,46 may be achieved when the backrest tube and the rear cross tube 64,66 are normally rotated around the hinged point. By adjusting the rotation angle of the armrest 80, the backrest tube 44,46 may be rotated about the seat tube 40,42. Thus, the angle of the backrest tube 44,46 may be adjusted, so as to improve the comfort of the chair. The armrest 80 may include a three-level adjustment, which can be achieved by providing a groove and a sliding protrusion.

It can be understood that the first slider 34,36 is provided along the rear foot tube 30,32 and above the second slider 50,52. When the folding chair frame is fully unfolded, the first slider 34,36 is in contact with the second slider 50,52. In such a position, a hinged point of the backrest tube 44,46 with the first slider 34,36 is substantially aligned with a hinged point of the rear cross tube 64,66 and the connecting tube 54,56 with the second slider 50,52. Such arrangement with approximate concentricity of the hinged connection points of the backrest tube with first slider and the rear cross tube and connecting tube with second slider, improves the adjustment effect and the pitch angle of the backrest tube 44,46, and in general the folding of the folding chair frame. The second slider 50,52 is connected to the rear cross tube 64,66 with a connection that allows two pivoting motions: (i) pivoting of the rear cross tube set so as to allow the rear cross tube set to be folded to bring the backrest tubes 44,46 adjacent to each other; and (ii) pivoting of the rear cross tube set relative to the rear foot tube 30,32. Thus, when the chair is unfolded, the backrest tube 44,46 and the rear cross tube 64,66 may be pivoted together in the same plane. In other words, when the angle of the backrest tube 44,46 is adjusted, the rear cross tube 64,66 is not required to slide on the backrest tube 30,32. This increases the stability without the need for additional support.

In one embodiment, the first connector 34,36 and the second connector 50,52 may be respectively embodied as a flip connector, and the flip connector may include hinge connections to other supporting members and may combine multiple supporting members. The hinge connection of the first connector 30,32 with the seat tube 40,42 and the hinge connection of the first connector with the backrest tube 44,46 may be achieved by means of the flip connector. As described earlier, the connecting tube 54,56 may be hinged to a respective rear cross tube 64,66 through the second connector 50,52. Other specific forms of the first connector and the second connector may also be provided, all of which are within the protection scope of the present application.

According to the folding chair frame provided by the present application, the first connector 34,36 is used for connecting the backrest tube 44,46 with the seat tube 40,42, and the second connector 50,52 is used for connecting the rear cross tube 64,66 with the connecting tube 54,56, so that the seat tube 40,42 and the backrest tube 44,46 are hingedly folded along the rear foot tube 30,32 when the folding chair frame is folded, which can reduce the packaging volume. When the folding chair frame is unfolded, the front foot tubes 26,28 and the rear foot tubes 30,32 are unfolded by gravity and secured by the first connector and the second connector on the rear foot tube, so as to solve the more complicated problem of manual operation on the supporting structure to achieve the folding in the conventional technology.

FIGS. 9 to 13 show the structure of a folding chair frame 120 according to another embodiment of the present application. A set of rear cross tube bodies 164,166 are cross-hinged and crosswise to each other and hingedly arranged between the two backrest tubes 144,146. First ends of the rear cross tubes 164,166 are hinged to the backrest tubes 144,146, and second ends of the rear cross tube bodies are hinged to the second connector 150,152. The first ends of the two rear cross tube 164,166 are respectively hinged to upper ends of the backrest tubes 144,146, and the second ends of the rear cross tube bodies are respectively hinged to the second connector 150,152 on the rear foot tube 130,132 of the foot tube assembly 122,124 opposite to the backrest tube on which the first end is located. The rear cross tubes 164,166 are folded or unfolded as the position of the second connectors 150,152 change, thereby allowing the backrest tubes 144,146 to be folded and providing lateral support force for the backrest tubes and the rear foot tubes 130,132. The lateral folding and supporting of the entire chair back is achieved by providing the front cross tubes 160,162 and the rear cross tubes 164,166. When the front foot tubes 126,128 and the rear foot tubes 130,132 are unfolded from the folded state, the connecting tubes 154,156 allow the second connectors to move from the bottom to the top on the rear foot tubes 130,132, and the first connectors hinged to the seat tubes 140,142 and the backrest tubes 144,146 also move on the rear foot tubes from the bottom to the top.

Specifically, in order to stabilize the chair frame after being unfolded, the rear foot tubes 130,132 are respectively fixed with a limiting member 190 and the limiting member 190 limits the maximum sliding position of the first connector 134,136 and the second connector 150,152 on each rear foot tube 130,132 as the folding chair frame is unfolded. The limiting member 190 is provided on each rear foot tube 130,132 of the two sets of the foot tube assemblies. The limiting member 190 may be welded, riveted or screwed to the rear foot tube 130,132 preferably in a detachably securing manning for easy disassembly. The limiting member 190 is provided at the upper end of the rear foot tube 130,132 to limit the maximum sliding positions of the first connector and the second connector on the rear foot tube, as in an embodiment, the limiting member 190 may be embodied as a protrusion welded on the rear foot tube, or the limiting member 190 and the rear foot tube are formed as an integral structure. When the first connector 134,136 and the second connector slide 150,152 on the rear foot tube 130,132 to come into contact with the limiting member 190, the upward sliding of the first connector and the second connector on the rear foot tube is restricted, so that the positions of the first connecting piece and the second connecting piece are unchanged, so as to provide supporting for the unfolded chair frame to ensure its stability.

It can be understood that the second connector 150,152 is provided on the rear foot tube 130,132 and below the first connector 134,136, in order to limit the sliding of the first connector and the second connector on the rear foot tube after the folding chair frame 120 is unfolded. The second connector 150,152 is provided with a locking assembly 192 that is fitted with the limiting member 190 in a case that the folding chair frame is unfolded, and the locking assembly is fitted with the limiting member 190 to limit the sliding of the second connector 150,152 along the rear foot tube 130,132. In an embodiment, a lock catch 196 may be provided on the second connector 150,152, and a groove fitting 198 that cooperates with the lock catch may be provided on the limiting member 190 to achieve fitting, or in an embodiment, the lock catch may be provided on the limiting member, and the groove fitting with the lock catch is provided at a corresponding position of the second connector, thereby the position of the second connector is locked. Since the first connector 134,136 is located between the second connector 150,152 and the limiting member 190, when the second connector is fitted with the limiting member to achieve the position fixing, correspondingly, the position of the first connector on the rear foot tube 130,132 is also fixed. In locking, the first connector 134,136 and the second connector 150,152 come into contact with the limiting member 190, and the locking assembly 192 on the second connector is engaged with the limiting member, so that the position thereof is fixed. When the chair frame 120 is required to be folded, the first connector 134,136 and the second connector 150,152 are unlocked on the rear foot tube 130,132 to achieve sliding by releasing the fitting relationship between the locking assembly and the limiting member 190.

Further, the lock catch 196 of the locking assembly 190 includes a hook 200 provided on the second connector. A hook mounting hole 202 for mounting the hook 200 is provided on the second connector. A hook mounting shaft (not shown) and a torsion spring (not shown) sleeved on the hook mounting shaft may be provided in the hook mounting hole 202. The limiting groove 198 for locking with the hook 200 may be provided on the limiting member 190. Preferably, the hook mounting hole 202 and the second connector 150,152 are formed as an integral structure, and the hook mounting hole is provided with a hook mounting shaft, which can be embodied as a pin. The torsion spring is sleeved on the hook mounting shaft. One end of the torsion spring abuts against the second connector 150,152 and another end of the torsion spring abuts against the hook 200 so that the hook can be opened or closed. When the hook 200 is latched with the limiting member, one end of the hook is pressed, so that the hook overcomes the elastic force of the torsion spring. The hook 200 is opened to release from the limiting groove 198 on the limiting member 190, and is locked by the spring force, whereby the second connector 150,152 may be locked with the limiting member 190. When the hook 100 and the limiting member 190 are unlocked, the above process is repeated to separate the hook from the limiting member. Of course, in other embodiments, the torsion spring can also be provided as a compression spring, as long as the same technical effect can be achieved. Thus, the specific form of the spring is not limited. The hook can also be embodied as a buckle and a hook & loop, of all which are within the protection scope of the present application.

Figure 9:
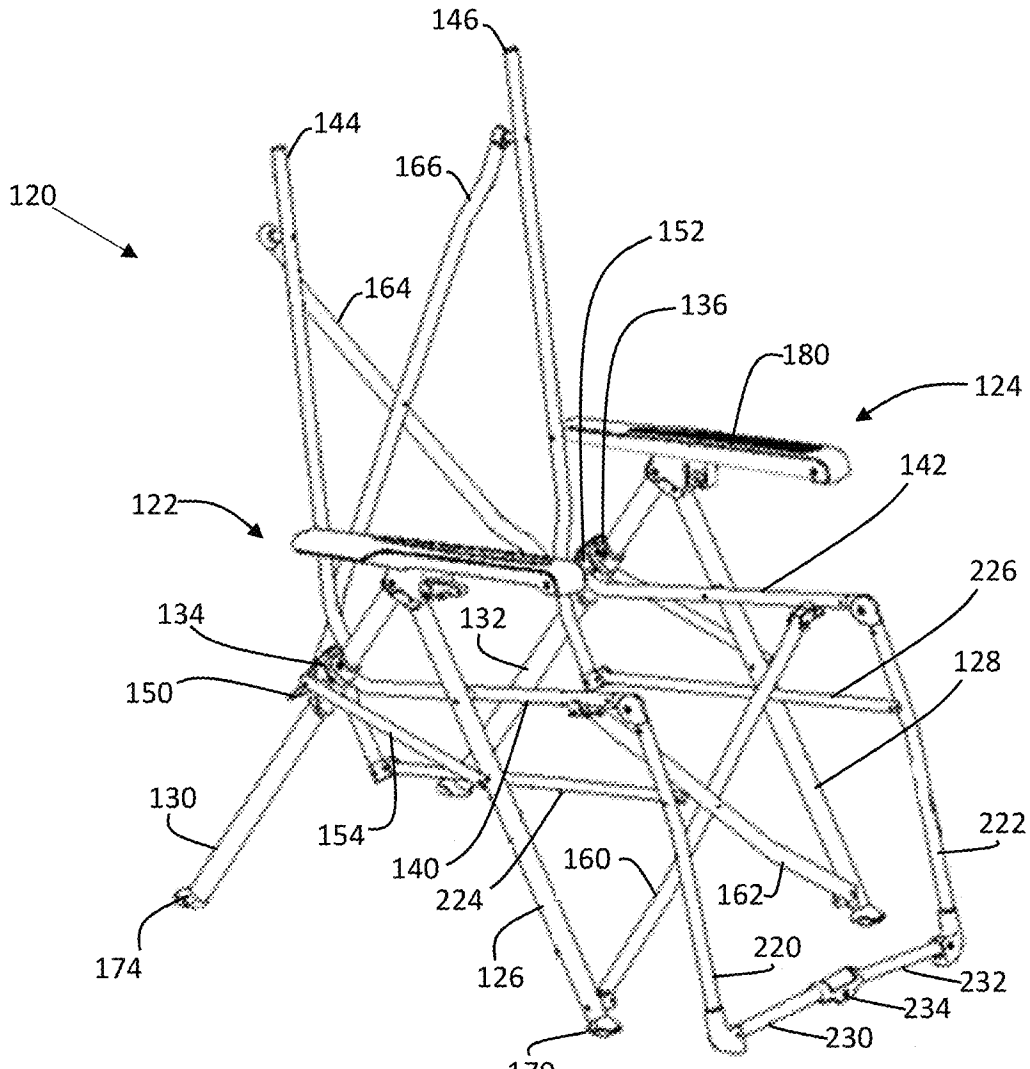
FIG. 9 is a front, left perspective view showing the structure of a folding chair frame according to another embodiment of the present application.
Figure 10:
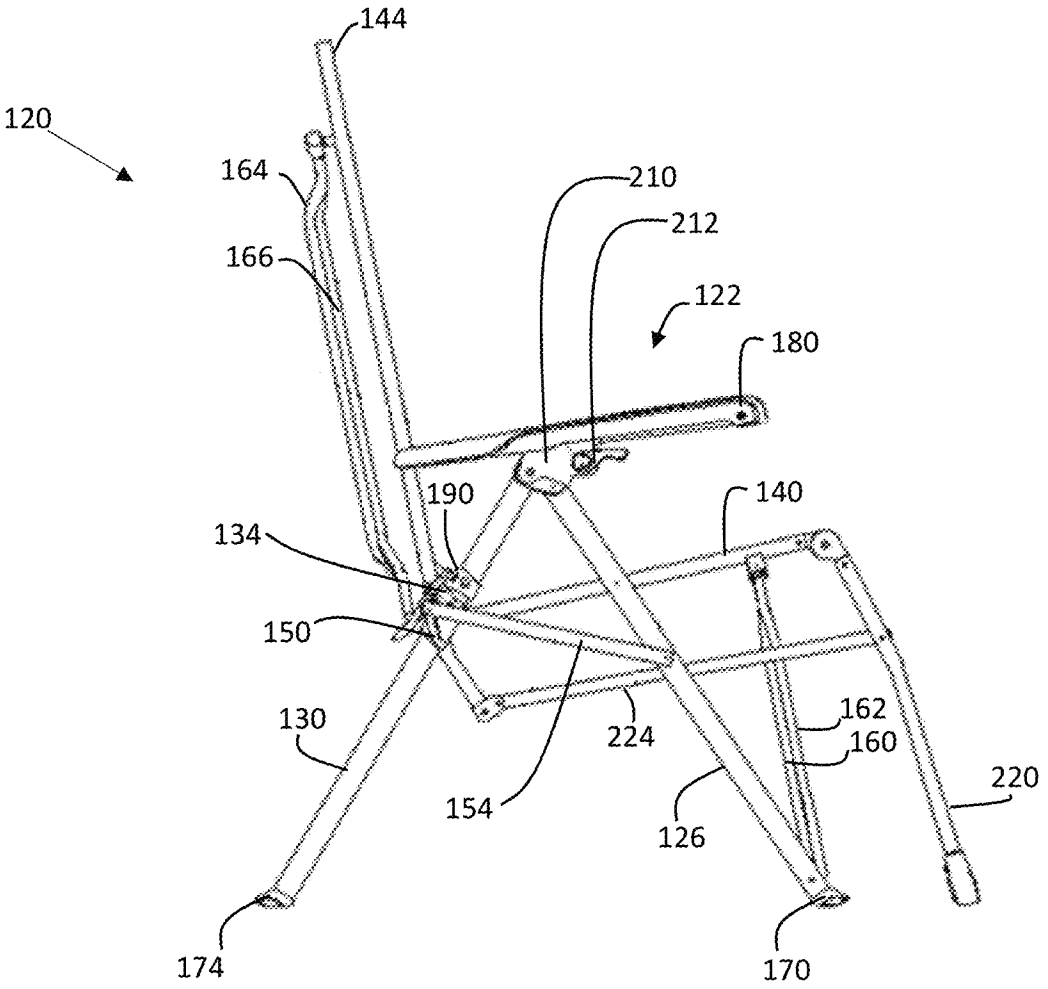
FIG. 10 is a left side elevation view of the folding chair frame in FIG. 9.
Figure 11:
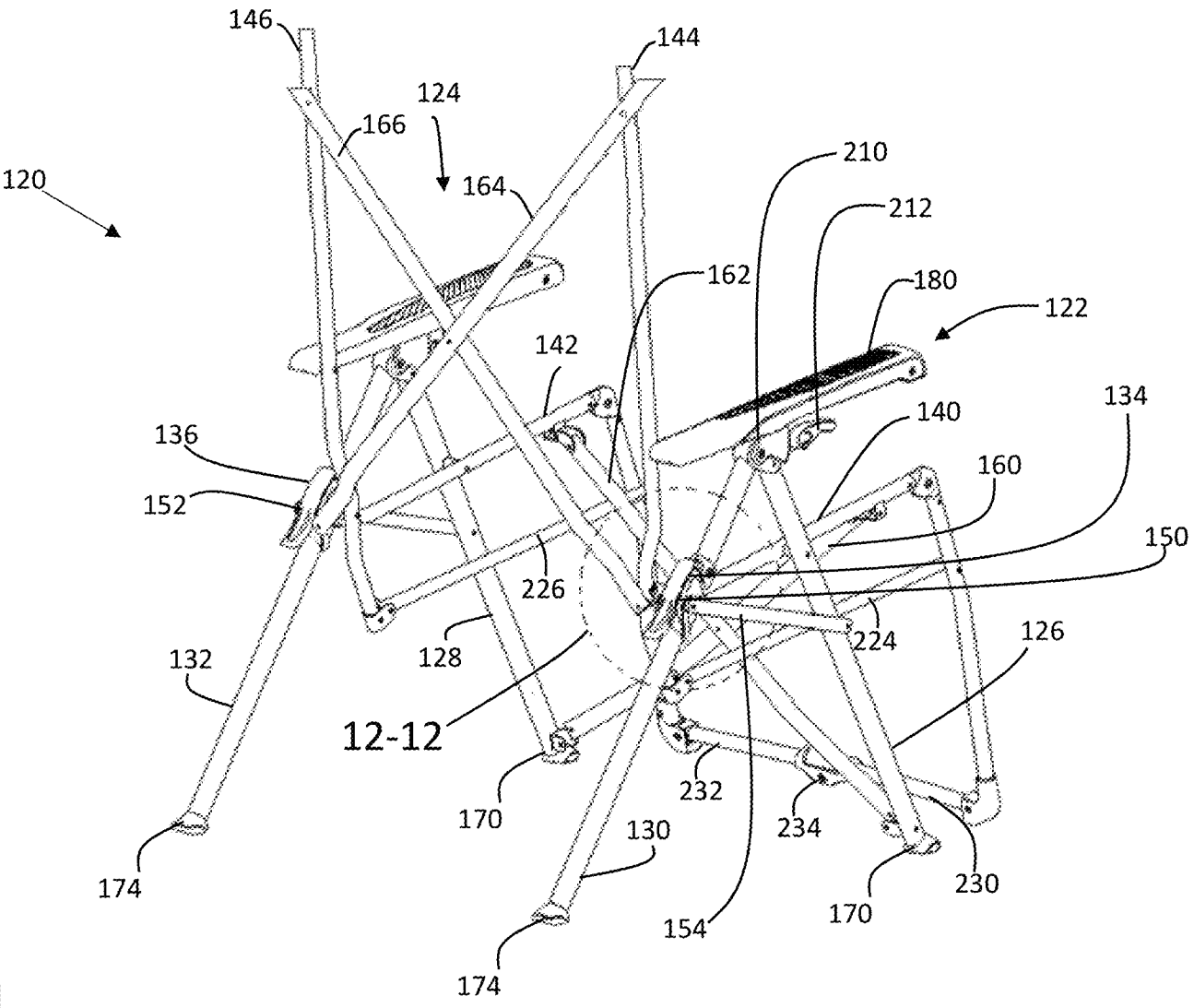
FIG. 11 is a rear, left perspective view of the folding chair frame in FIG. 9.
Figure 12:
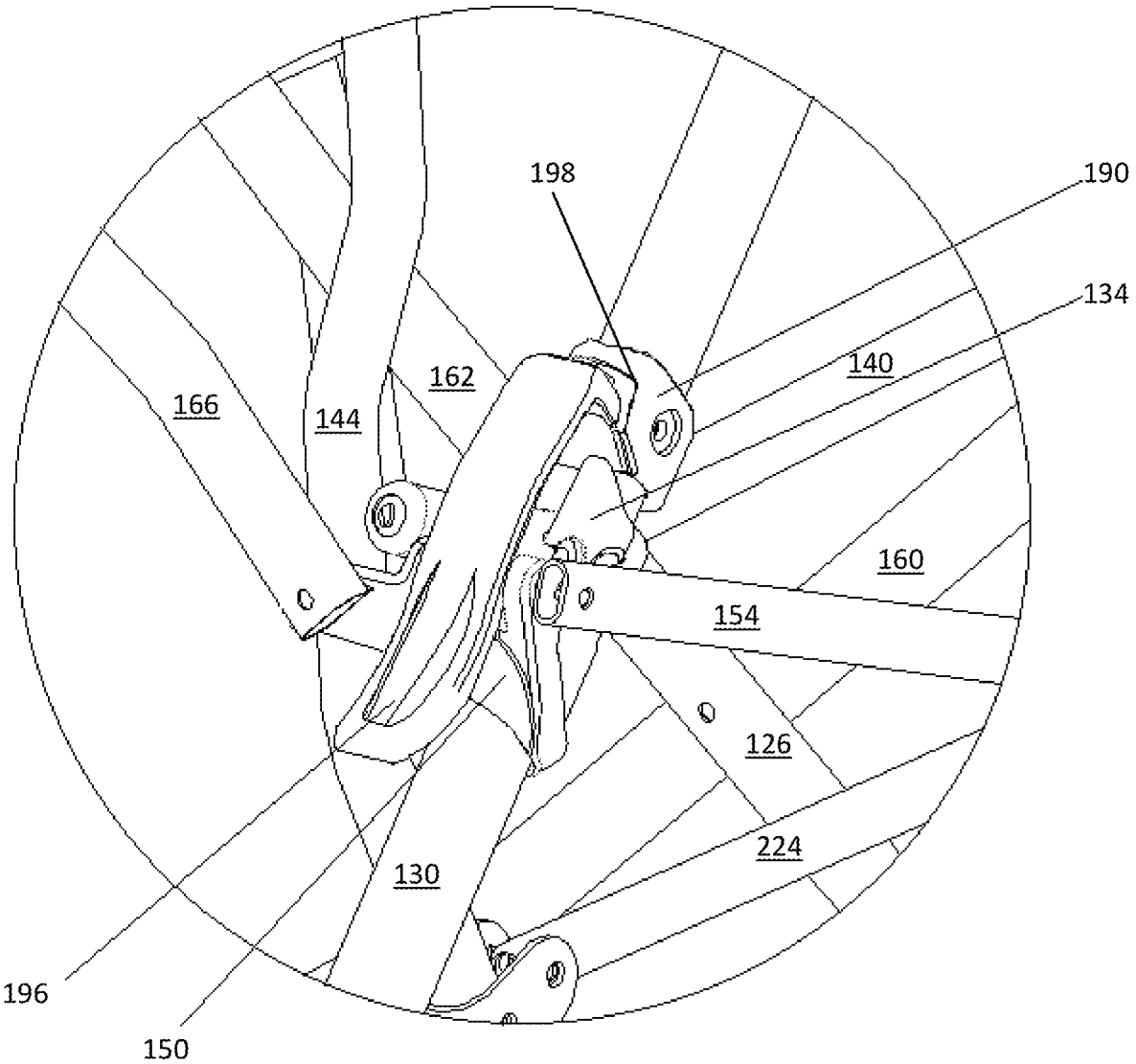
FIG. 12 is an enlarged view of detail area A of FIG. 11.
Figure 13:
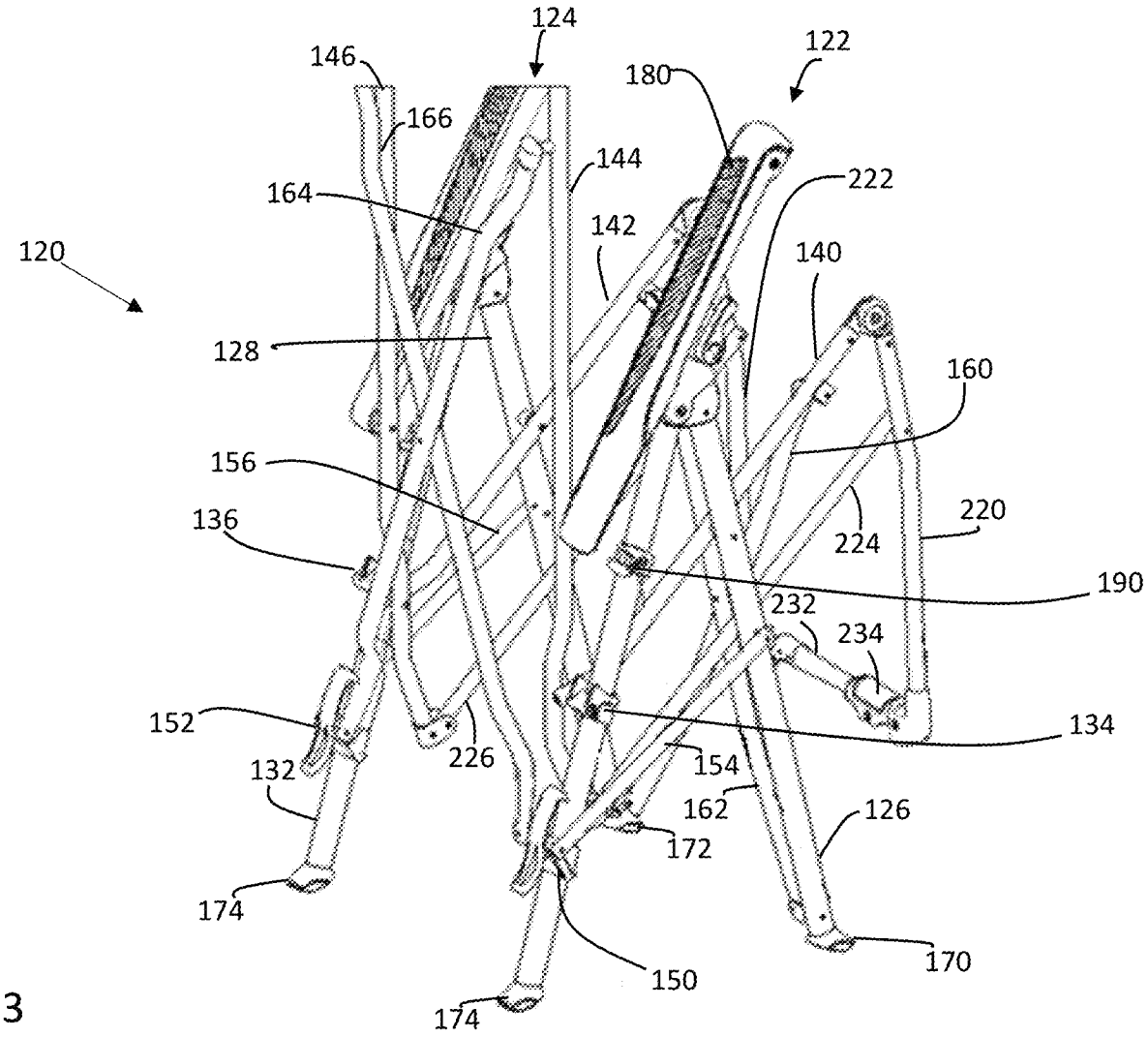
FIG. 13 is a rear, right perspective view showing the structure of the folding chair frame of FIG. 9 in a partially folded state.
Figure 14:
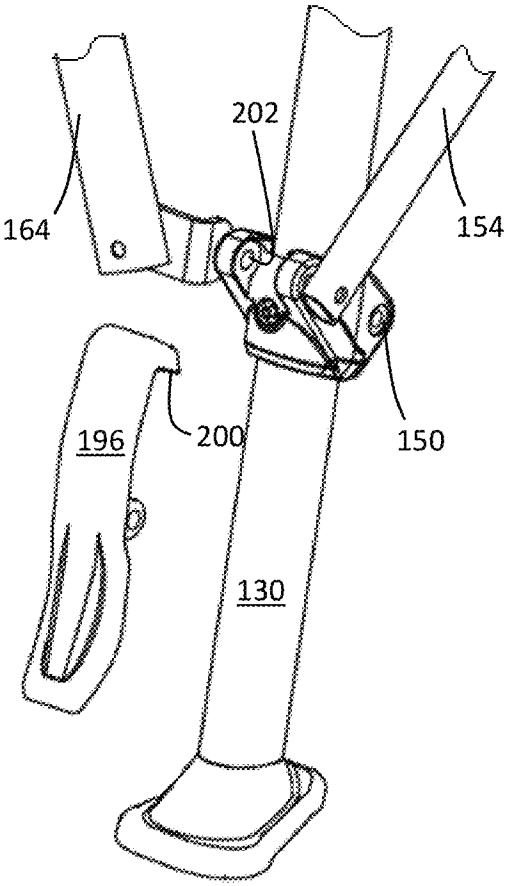
FIG. 14 is an exploded view of a second connector of the rear foot tube providing additional detail of a latch connection that engages the first connector.

In the embodiment of FIGS. 9 and 13, the top hinged portion of the front foot tube 126,128 and the rear foot tube 130,132 is hinged to an armrest body 180. The armrest body 180 has one end hinged to the backrest tube 144,146 to adjust a pitch angle of the backrest tube as the armrest body rotates. The armrest body 180 rotates relative to the top hinged portion of the front foot tube 126,128 and the rear foot tube 130,132, around the hinged point, specifically by setting a pin. The end of the armrest body 180 is hinged to the backrest tube 144,146, and the pitch angle of the backrest tube is adjusted when the armrest body rotates around the top hinged portion. When the chair frame 120 is folded or unfolded, the first connector 134,136 is slidable on the rear foot tube 130,132, which can allow the backrest tube 144, 146 and the armrest body 180 hinged to the backrest tube to rotate along the hinged point. This allows folding and movement of the armrest body 180 between the horizontal state when the frame is unfolded and the vertical state when the frame is folded.

Further, a sliding assembly is further provided between the armrest body 180 and the top hinged portion to allow the armrest body to slide along its length to adjust the pitch angle of the backrest tube 144,146. The armrest body 180 is hinged to the top hinged portion through the sliding assembly. The sliding assembly includes a hinged seat 210 hinged to the top hinged portion, and the armrest body 180 is slidable on the hinged seat.

It can be understood that the hinged points of the armrest body 180, the backrest tube 144,146 and the first connector 134,136 form a triangle. When the chair frame is unfolded, each side length of the triangle is fixed, and the pitch angle of the backrest tube 144,146 cannot be adjusted at this time. The angle between the backrest tube 144,146 and the rear foot tube 130,132 where the first connector is located is adjusted by adjusting the length of the side where the armrest body 180 is located, thereby adjusting the pitch angle of the chair frame. The sliding assembly includes a hinged seat 210 provided on the top hinged portion and the armrest body 180 is slidable on the hinge seat 210, which can be achieved by providing a sliding rail. Preferably, the hinged seat 210 is provided with a sliding limit assembly 212 for limiting the sliding of the armrest body 180. The sliding limiting assembly 212 may be embodied as a toggle or a button, as is known in conventional technology.

Based on the above embodiments, the front ends of the seat tubes 4 are respectively hingedly provided with a footrest tube 220,222. The footrest tube 220,222 is hinged to a linkage tube 224,226 which has one end hinged to the footrest tube 220,222 and another end hinged to the backrest tube 144,146. The footrest tube 220,222 is pushed by the linkage tube 224,226 to rotate along the hinged point of the front end of the seat tube 140,142 to form a recliner in a case that the backrest tube 144,146 is pitched back.

It can be understood that the backrest tube 144,146 is provided with a protruding end, and one linkage tube 224,226 is provided on the protruding end. The linkage tube 224,226 is preferably provided in parallel with the seat tube 140,142. One end of the linkage tube 224,226 is hinged to the backrest tube 144,146, and another end of the linkage tube 224,226 is hinged to the footrest tube 220,222. When the backrest tubes 144,146 are pitched back, the pitch angle becomes larger, which pushes the linkage tubes 224,226 to move forward and allow the footrest tubes 220,222 to rotate along each hinged point of the footrest tubes and the seat tubes 140,142, that is, the footrest tubes 220,222 rotate forward around each hinged point, so that the angle between the plane of the two footrest tubes 220,222 and the horizontal plane becomes smaller, forming an extension surface for accommodating the feet and legs. In this configuration, the folding chair frame has the function of a recliner. When the chair frame is folded, the pitch angle of the backrest tubes 144,146 becomes smaller. The backrest tubes 144,146 then drive the linkage tubes 224,226 to move backward, and then drive the footrest tubes 220,222 to rotate backward around each hinged point, so that angle between the plane of the two footrest tubes 220,222 and the horizontal plane becomes larger, and the extension surface is folded to a vertical state.

In the above embodiment, the connection between the two footrest tubes 220,222 may be achieved by providing a canvas or a quick-drying cloth. In one embodiment, a cross-bracing connector 230,232 is provided between the two footrest tubes 220,222 for connecting the two footrest tubes. The cross-bracing connector 230,232, may have left and right portions pivotally connected. The laterally opposite ends of the cross-bracing connector 230,232 are respectively hinged to the footrest tubes 220,222. The cross-bracing connector 230,232 may folded via the pivot connection 234 when the folding chair frame is folded, and configured to support the footrest tube 220,222 when the folding chair frame is unfolded. In one embodiment, the cross-bracing connector may be provided as a supporting belt or a strap, and the supporting belt may laid in a mesh or in a horizon along the length direction of the footrest tubes for supporting for the legs. Preferably, the cross-bracing connector 230,232 includes a first connecting supporter and a second connecting supporter that are bisected along a center point of the cross-bracing connector and hinged via the pivot connector 234. The first connecting supporter 230 and the second connecting supporter 232 are configured to horizontally support the footrest tubes 220,222 in a case that the folding chair frame is unfolded. The first connecting supporter 230 or the second connecting supporter 232 can be sleeved with a cross-bracing portion for horizontally supporting the hinged portion of the two when the folding chair frame is unfolded. The sleeve can be moved along the first connecting supporter or the second connecting supporter to allow the first connecting supporter to pivot relative to the second connecting supporter when the folding chair is folded. The sleeved cross-bracing portion is provided in the axial direction of the cross-bracing connector 230,232. Such arrangement can increase the supporting force at the footrest tubes when the chair frame is unfolded. The cross-bracing connector 230,232 is divided into the first connecting supporter and the second connecting supporter at a central point, and the two may be hingedly arranged at the central point 234 to achieve folding when the chair frame is folded and to form the support when the folding chair frame is unfolded. In order to increase the lateral supporting force of the cross-bracing connector 230,232 after the folding chair frame is unfolded, the first connecting supporter or the second connecting supporter can be sleeved with the cross-bracing portion, which is provided in the axial direction of the first connecting supporter or the second connecting supporter, so as to support the hinged portion of the two. The cross-bracing portion is preferably detachable and fixable to the cross-bracing connector 230,232. The cross-bracing portion is preferably a plastic tube, which can be set according to actual requirements, and there is no limitation on the material.

Alternatively, in an embodiment, the cross-bracing connector 230,232 includes the first connecting supporter and the second connecting supporter that are crosswise to each other and hingedly arranged, and one end of the first connecting supporter is hingedly arranged with one footrest tube 220,222 and one end of the second connecting supporter is hingedly arranged with another footrest tube. Such arrangement can form a cross-bracing support and can provide the lateral supporting force for the footrest tube after the folding chair frame is unfolded.

To move the folding chair frame from the folded state to the unfolded state, the following steps may be performed: (i) the two sets of foot tube assemblies are laterally moved, which allows the front cross tubes, the rear cross tube bodies, and the footrest tubes to be laterally supported; (ii) at the same time, the second connectors are moved from the bottom to the top along the rear foot tubes under the moving of the rear cross tube bodies; (iii) the seat tubes 4 are moved under the moving of the front cross tubes, which further allows the first connectors to move from the bottom to the top along the rear foot tubes; (iv) each side length of the triangle is formed by the first connector, the backrest tube and the armrest body changes, which allows the armrest bodies to be transformed from the vertical state to the horizontal state; (v) the pitch angle of the backrest tubes can be adjusted by adjusting the sliding assemblies on the armrest bodies, and simultaneously the angle between the footrest tubes and the seat tubes can be adjusted under the moving of the linkage tubes, thereby achieving transforming to the recliner from the chair.

Figure 15:
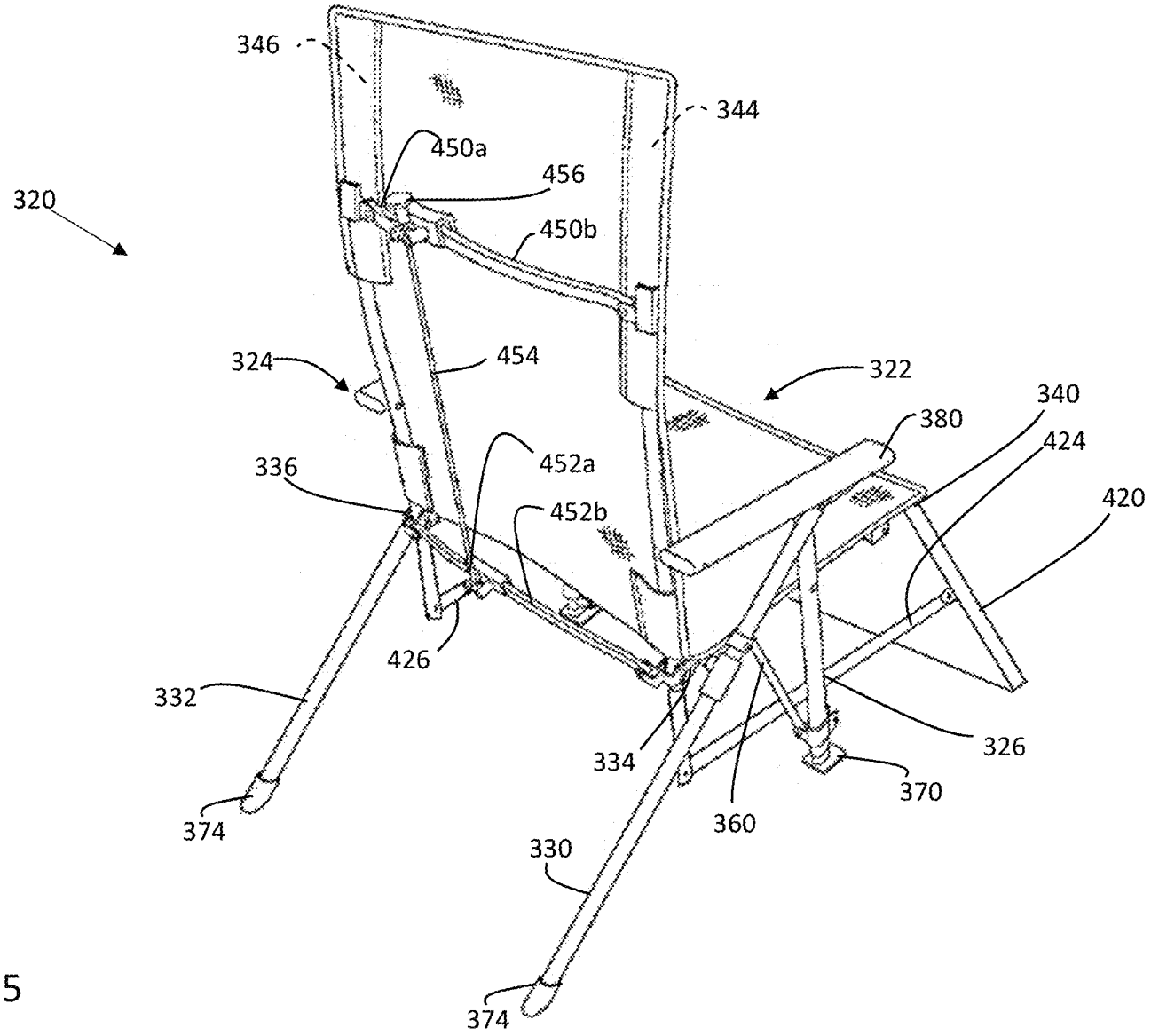
FIG. 15 is a rear perspective view of another embodiment of the folding chair frame.
Figure 16:
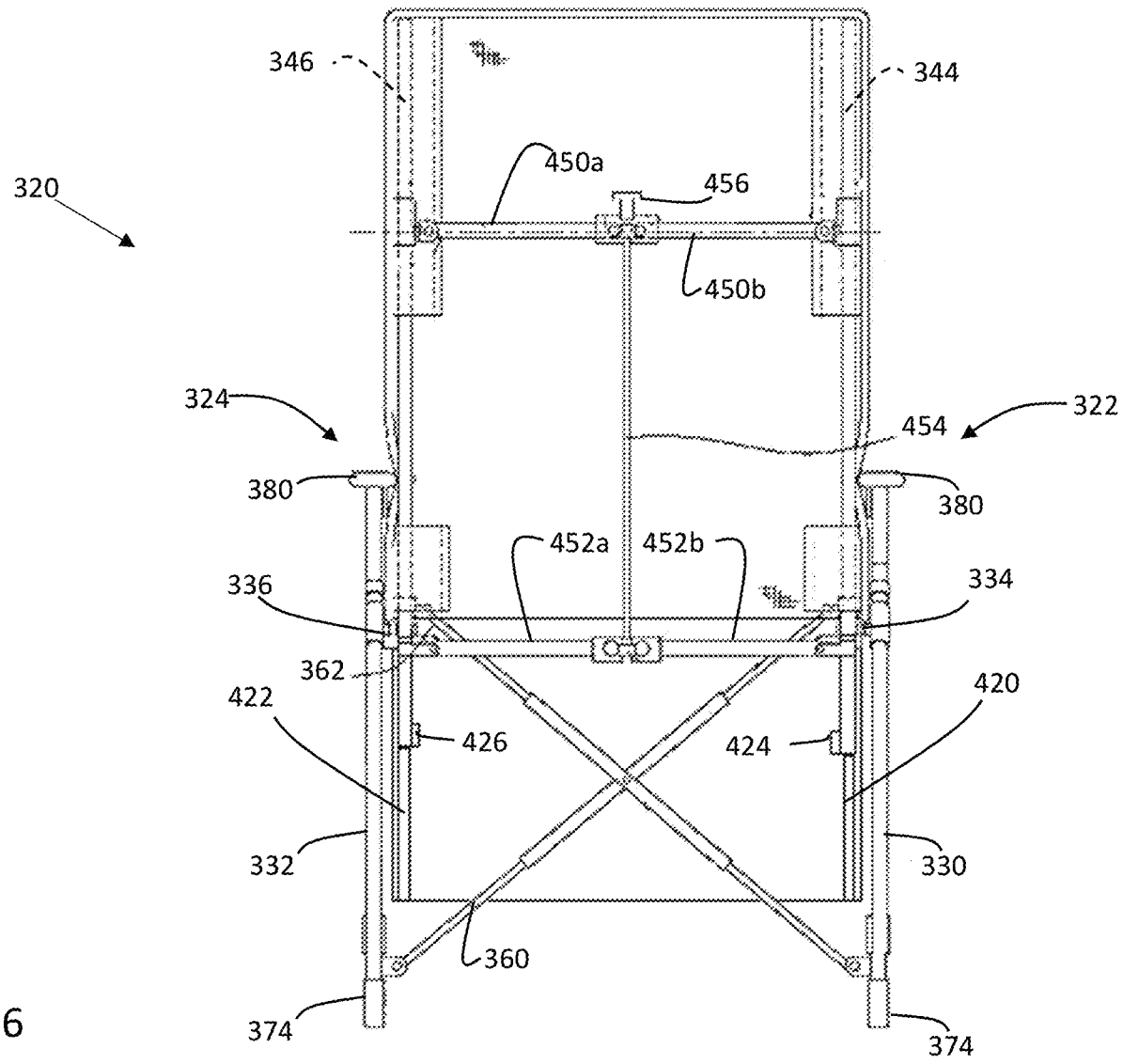
FIG. 16 is a rear elevation view of the folding chair frame in FIG. 15.
Figure 17:
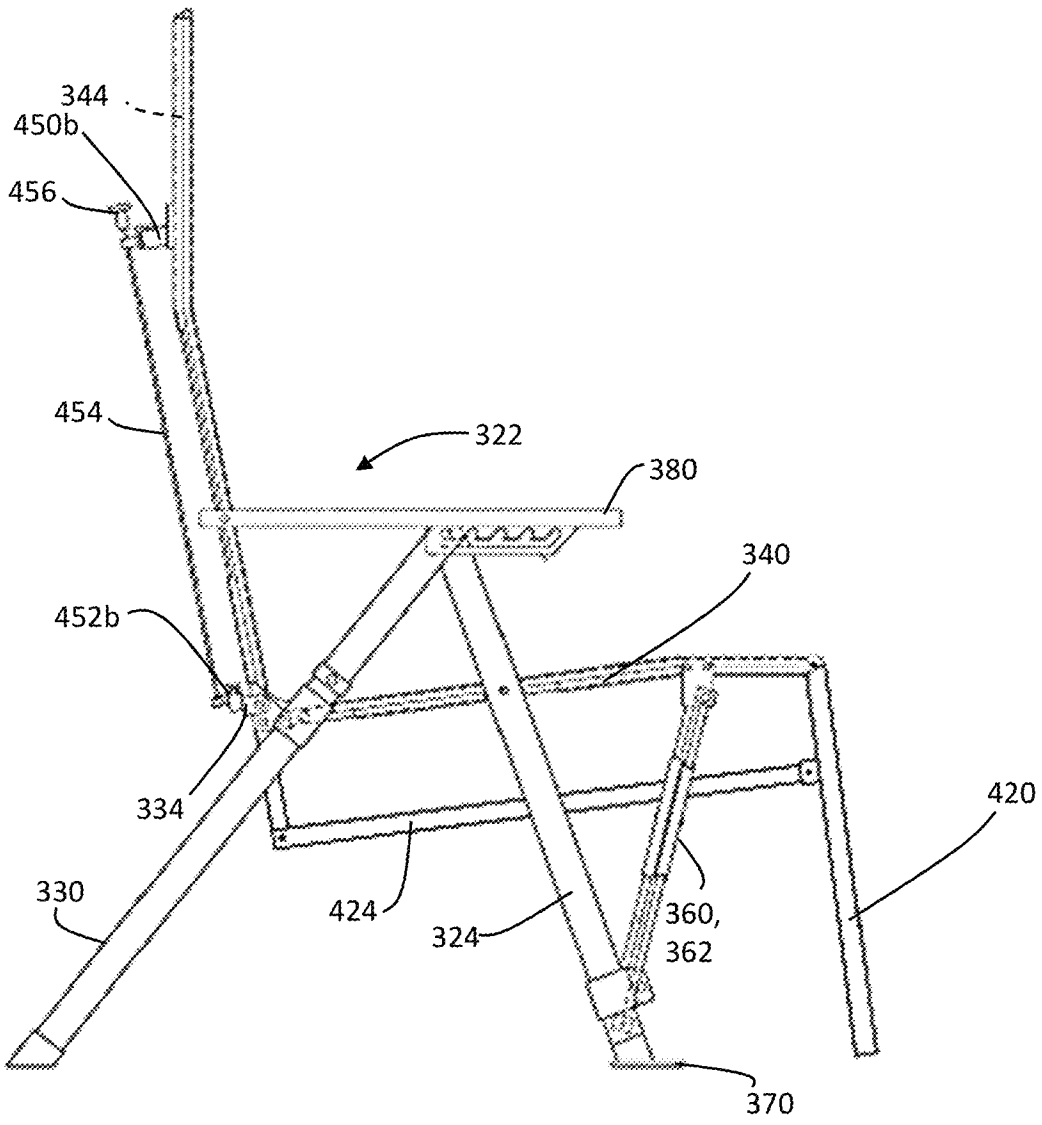
FIG. 17 is a left side elevation view of the folding chair frame in FIG. 15.
Figure 18:
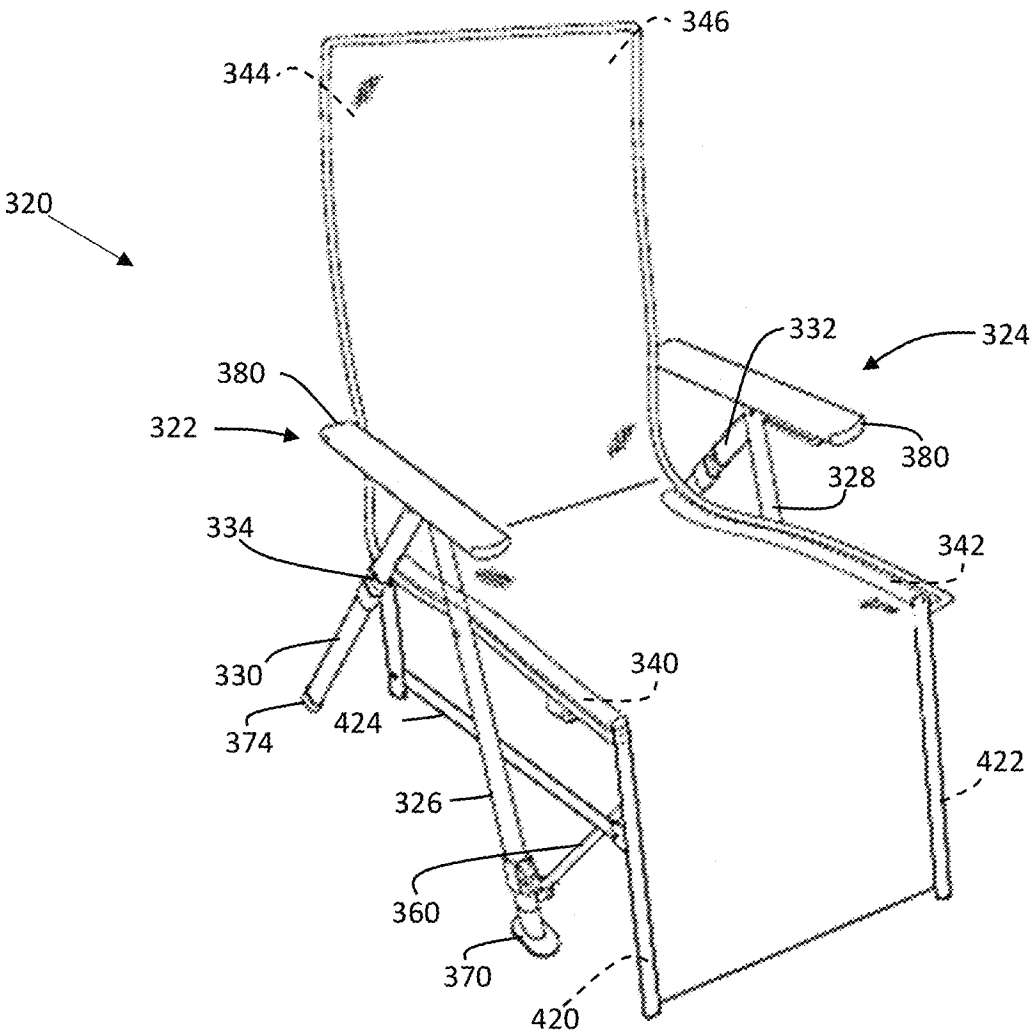
FIG. 18 is a front perspective view of the folding chair frame in FIG. 15.

FIGS. 15-17 provide another embodiment of a foldable chair frame 320 that omits the rear cross tube set of the chair frame embodiments of FIGS. 1-14 and the second sliding connector on the rear foot tubes. The folding chair frame includes first and second foot tube assemblies 322,324, having front foot tubes 326,328, and rear foot tubes 330,332. The front foot tubes and rear foot tubes are pivotally connected at their tops to armrests 380. The folding chair frame further includes first and second seat tubes 340,342 and first and second back rest tubes 344,346. The seat tubes 340,342 and back rest tubes 344,346 are operatively pivotally connected to each via a first connector 334,336. The front cross tube set 360,362 includes two tubes arranged in a cross-hinged manner, and one end of each tube is connected to the front end of the seat tube 340,342 of one foot tube assembly and another end of the tube is connected to the bottom end of the front foot tube 326,238 of the other foot tube assembly to achieve crosswise arrangement. The front ends of the seat tubes 340,342 are pivotally connected to foot rest tubes 420,422. Linkage tubes 424,426 are pivotally connected to the foot rest tubes 420,422 and depending portions of the back rest tubes 344,346. The bottom portions of the front foot tubes have pivot connections with front cross tubes that extend to and are pivotally connected with the seat tubes 340,342.

Top backrest linkages 450*a*,450*b* and bottom backrest linkages 452*a*,452*b* are pivotally connected to backrest tubes 344,346 and a back rest linkage support 454. One end of the top backrest linkage 450*a*,450*b* is pivotally connected to and extends from a top region of the respective backrest tubes 344,346, and an opposite end of the top backrest linkage 450*a*,450*b* is pivotally connected to and extends from a top region of the back rest linkage support 454. One end of the bottom backrest linkage 452*a*,452*b* is pivotally connected to and extends from the respective first connector 334,336, and an opposite end of the bottom backrest linkage 452*a*,452*b* is pivotally connected to and extends from the back rest linkage support 454. The backrest linkage support 454 includes a handle 456 that allows the backrest linkage support to move upward and downward in the drawings thereby allowing the top backrest linkages 450*a*,450*b* and the bottom backrest linkages 452*a*,452*b* to move toward and away from each other and the backrest support linkage for folding and unfolding of the chair frame. In use, the handle 456 may be pulled upwardly, such as to drive the backrest linkages 450*a*,450*b*,452*a*,452*b* upward. The chair frame may be converted from an unfolded configuration to a folded configuration as the backrest linkages gradually moves upwards, which in turn pulls the foot tube assemblies 322,324 toward each other. In the unfolded configuration, to adjust the backrest tilt angle, each of the armrest 380 may be lifted up (for instance, at the front end of the armrest), and the back rest may be pivoted as desired.

Finally, it should be noted that in this article, relational terms such as first and second are used only to distinguish one entity or operation from another entity or operation, without necessarily requiring or implying any such actual relationship or order between these entities or operations. Moreover, the term "include", "comprise" or any other variation thereof is intended to cover non-exclusive inclusions, so that a process, a method, an object or a device including a series of elements includes not only those elements, but also other elements that are not explicitly listed, or the elements inherent in the process, the method, the object or the device. In the absence of further restrictions, elements limited by the statement "includes one . . . " do not exclude the existence of other identical elements in processes, methods, articles or equipment that include the said elements.

The various embodiments in this specification are described in a progressive manner. Respectively embodiment focuses on the differences from other embodiments, and the same and similar parts among the embodiments can be referred to each other.

The above description of the disclosed embodiments enables those skilled in the art to implement or use the present application. Various modifications to these embodiments are apparent to those skilled in the art, and the general principles defined herein may be implemented in other embodiments without departing from the spirit or scope of the present application. Therefore, the present application will not be limited to the embodiments shown herein, but will conform to the widest range consistent with the principles and novel features disclosed herein.

The invention claimed is:

1. A folding chair having a frame, the frame comprising first and second foot tube assemblies, each foot tube assembly comprising: a front foot tube and a rear foot tube operatively pivotally connected together, the rear foot tube having a first connector, the first connector being slidable along the rear foot tube; a seat tube operatively pivotally connected to the front foot tube, the seat tube having an end operatively pivotally connected to the first connector; a backrest tube, the backrest tube being operatively pivotally connected to the first connector; and the frame having a front cross tube, the front cross tube having an end operatively pivotally connected to the seat tube of the first foot tube assembly and an opposite end operatively pivotally connected adjacent a bottom end of the foot tube of the second foot tube assembly; the rear foot tube of each foot tube assembly having a second connector, the second connector being slidable on the rear foot tube; and a connecting tube for each foot tube assembly, the connecting tube having one end operatively pivotally connected to the second connector and an opposite end operatively pivotally connected to the front foot tube; and wherein one of the first connector and the second connector of each foot tube assembly has a latch and the other of the first and second connector has a groove that engages with the latch to releaseably connect the first and second connectors together.

2. The folding chair according to claim 1, wherein the front cross tube is one in a set of two front cross tubes, a first tube of the set has the one end operatively pivotally connected to the seat tube of the first foot tube assembly and the opposite end operatively pivotally connected adjacent the bottom end of the foot tube of the second foot tube assembly, a second tube of set has one end operatively pivotally connected to the seat tube of the second foot tube assembly and an opposite end operatively pivotally connected adjacent a bottom end of the foot tube of the first foot tube assembly.

3. The folding chair according to claim 1, wherein the first and second connectors move away from each other along the rear foot tube as the frame is folded, the first and second connectors move toward each other along the rear foot tube as the frame is unfolded.

4. The folding chair according to claim 1, wherein the front foot tube and the front cross tube of each foot tube assembly are operatively pivotally connected together by a foot connector, the foot connector has one end fixedly connected to the front foot tube and another end pivotally connected with the front cross tube.

5. The folding chair according to claim 1, wherein the rear foot tube of each foot tube assembly has a foot sleeve configured for preventing slipping.

6. The folding chair according to claim 1, wherein each of the foot tube assemblies has an armrest, the armrest being operatively pivotally connected to the backrest tube and operatively pivotally connected to the front and rear foot tubes.

7. The folding chair according to claim 1, wherein the frame comprises a rear cross tube, the rear cross tube has one end operatively pivotally connected adjacent to an end of each backrest tube of the first tube assembly and an opposite end operatively pivotally connected to the connecting tube of the second foot tube assembly.

8. The folding chair according to claim 7, wherein the rear cross tube is one in a set of two rear cross tubes, a first tube of the set has the one end operatively pivotally connected adjacent to the end of the backrest tube of the first foot tube assembly and the opposite end operatively pivotally connected to the connecting tube of the second foot tube assembly, a second tube of the set has one end operatively pivotally connected adjacent to an end of the backrest tube of the second foot tube assembly and an opposite end operatively pivotally connected to the connecting tube of the first foot tube assembly.

9. The folding chair according to claim 8, wherein each tube of the set of rear cross tubes has the one end operatively pivotally connected to the respective backrest tubes and the opposite end operatively pivotally connected to a respective second connector of the rear foot tube.

10. The folding chair according to claim 1 wherein a front end of each of the seat tubes is operatively pivotally connected with a footrest tube, the footrest tube is operatively pivotally connected to a linkage tube, the linkage tube has one end operatively pivotally connected to the footrest tube and an opposite end operatively pivotally connected to a respective backrest tube, the footrest tube is configured to rotate about the front end of the respective seat tube as the linkage tube moves relative to rear foot tube and the backrest tube rotates relative to rear foot tube.

11. The folding chair frame according to claim 10, wherein a cross-bracing connector extends between the footrest tubes, laterally opposite ends of the cross-bracing connector are respectively operatively pivotally connected to the respective footrest tubes, the cross-bracing connector being foldable when the folding chair frame is folded, the cross-bracing connector being configured to support the footrest tube when the folding chair frame is unfolded.

12. The folding chair frame according to claim 11, wherein the cross-bracing connector comprises a first connecting supporter operatively pivotally connected with a second connecting supporter.

13. A folding chair having a frame, the frame comprising first and second foot tube assemblies, each foot tube assembly comprising: a front foot tube and a rear foot tube operatively pivotally connected together, the rear foot tube having a first connector, the first connector being slidable along the rear foot tube; a seat tube operatively pivotally connected to the front foot tube, the seat tube having an end operatively pivotally connected to the first connector; a backrest tube, the backrest tube being operatively pivotally connected to the first connector; and the frame having a front cross tube, the front cross tube having an end operatively pivotally connected to the seat tube of the first foot tube assembly and an opposite end operatively pivotally connected adjacent a bottom end of the foot tube of the second foot tube assembly; the rear foot tube of each foot tube assembly having a second connector, the second connector being slidable on the rear foot tube; and a connecting tube for each foot tube assembly, the connecting tube having one end operatively pivotally connected to the second connector and an opposite end operatively pivotally connected to the front foot tube; and wherein the rear foot tube of each of the foot tube assemblies is provided with a limiting member fixedly connected to the rear foot tube, the limiting member being configured to limit sliding of the first connector and the second connector on the respective rear foot tube.

14. The folding chair according to claim 13, wherein the second connector is provided with a locking assembly that is configured to engage with the limiting member when the folding chair frame is unfolded.

15. The folding chair according to claim 14, wherein the locking assembly comprises a hook, the hook is pivotally mounted on the second connector, the hook is biased to rotate toward the limiting member for locking of the hook with the limiting member.

16. The folding chair according to claim 13 wherein a front end of each of the seat tubes is operatively pivotally connected with a footrest tube, the footrest tube is operatively pivotally connected to a linkage tube, the linkage tube has one end operatively pivotally connected to the footrest tube and an opposite end operatively pivotally connected to a respective backrest tube, the footrest tube is configured to rotate about the front end of the respective seat tube as the linkage tube moves relative to rear foot tube and the backrest tube rotates relative to rear foot tube.

17. The folding chair frame according to claim 16, wherein a cross-bracing connector extends between the footrest tubes, laterally opposite ends of the cross-bracing connector are respectively operatively pivotally connected to the respective footrest tubes, the cross-bracing connector being foldable when the folding chair frame is folded, the cross-bracing connector being configured to support the footrest tube when the folding chair frame is unfolded.

18. The folding chair frame according to claim 17, wherein the cross-bracing connector comprises a first connecting supporter operatively pivotally connected with a second connecting supporter.

19. The folding chair according to claim 13, wherein each of the foot tube assemblies has an armrest, the armrest being operatively pivotally connected to the backrest tube and operatively pivotally connected to the front and rear foot tubes.

20. The folding chair according to claim 13, wherein the first and second connectors move away from each other along the rear foot tube as the frame is folded, the first and second connectors move toward each other along the rear foot tube as the frame is unfolded.

* * * * *